United States Patent [19]

Yokota

[11] Patent Number: 4,690,344

[45] Date of Patent: Sep. 1, 1987

[54] ROLL HOLDER

[75] Inventor: Mamoru Yokota, Yaizu, Japan

[73] Assignee: Yazaki Industrial Chemical Co., Ltd., Shizuoka, Japan

[21] Appl. No.: 835,763

[22] Filed: Mar. 3, 1986

[30] Foreign Application Priority Data

Feb. 18, 1986 [JP] Japan ..... 61-21898[U]

[51] Int. Cl.[4] ..... B65H 19/00; B65H 20/02; B26F 3/00

[52] U.S. Cl. ..... 242/55.53; 225/10; 225/106; 226/156; 312/39

[58] Field of Search ..... 242/55.2, 55.53; 226/152, 156; 225/10, 106; 83/367; 312/37-39

[56] References Cited

U.S. PATENT DOCUMENTS

| | | | |
|---|---|---|---|
| 3,167,368 | 1/1965 | Rozlog et al. | 312/39 |
| 3,297,269 | 1/1967 | McGrew | 312/39 X |
| 3,301,617 | 1/1967 | Goodwin et al. | 242/55.53 X |
| 3,697,146 | 10/1972 | Boisen | 242/55.53 X |
| 3,826,548 | 7/1974 | Schnyder et al. | 312/38 |
| 3,951,485 | 4/1976 | Schnyder et al. | 242/55.53 X |
| 4,073,422 | 2/1978 | Palter | 226/156 X |

*Primary Examiner*—Stuart S. Levy
*Assistant Examiner*—David Werner
*Attorney, Agent, or Firm*—Franklin D. Wolffe; Morris Fidelman

[57] ABSTRACT

A roll holder for holding rotatably a roll of consecutive thin-film-like products and paying out a succeeding product up to a given position as the preceding product is cut off along a break line provided between individual units of use, whose body has holding portions for holding rotatably the winding core of the roll of consecutive products to hang the same; a first feed roll to be rotated by a motor; and a detector for detecting the presence/absence of the succeeding product at a given position, whose lid has a second feed roll coming into abutment on the first feed roll when the lid is shut and locked by a lock mechanism with respect to the body, and whose control unit, after the detector detects the absence of the succeeding product, causes the motor to rotate the first feed roll to thereby pay out the succeeding product, and after the detector detects the presence of the succeeding product, causes the motor to rotate the first feed roll a certain amount of rotation to thereby pay out the succeeding product up to the given position.

1 Claim, 13 Drawing Figures

ROLL HOLDER

BACKGROUND OF THE INVENTION

1. Field of the Invention

This invention relates to a roll holder for holding rotatably a roll of consecutive thin-film-like products, with break lines such as perforations provided between individual units of use, in the form of a chain of pouches or of a film made of synthetic resin or paper and, more particularly, to the type of roll holder in which a succeeding product is automatically paid out up to a given position by cutting off the preceding product along the break line.

2. Description of the Prior Art

One prior technique concerning the roll holder which holds rotatably a roll of consecutive thin-film-like products, with break lines such as perforations provided between individual units of use, in the form of a chain of pouches or of a film made of synthetic resin or paper, was proposed in Japanese Utility Model Application No. 57-94144 by the applicant of the present application.

The foregoing prior roll holder is configured so that a pair of feed rolls are mounted fixedly and a roll of products is automatically paid out through motor-driving. Thus, this type of roll holder has the defects that the work of inserting at the start a roll of consecutive thin-filmlike products between the feed rolls takes much time and requires a complicated manipulation.

SUMMARY OF THE INVENTION

It is an object of the present invention to provide a roll holder whose feed rolls are mounted separately on an open/shut lid and a body.

To achieve the foregoing object, the present invention provides a roll holder for holding rotatably a roll of consecutive thin-film-like products whose individual product is used by being cut off along a break line such as perforations provided between individual units of use and paying out a succeeding product up to a given position upon cutting off of the product along the break line comprising a body and a lid open/shut-able with respect to the former via a hinge, which is characterized by, provided inside the body holding portions for holding rotatably a winding core so as to hang the roll; a feed roll disposed in parallel with the roll and having a circumferential groove, one end of whose shaft is held by a bearing with the other end passing through a hole of a bulkhead and having either a pulley or sprocket attached thereto, either the pulley or sprocket being coupled via either a belt or chain to a motor for providing a turning force in a given direction; a lower product guide arranged along the circumferential groove and attached to a mounting piece; and a detector disposed at a downstream position spaced a given distance from the feed roll in a pay-out path along which the consecutive thin-film-like products run and stop for detecting the presence/absence of the succeeding product at that position.

The roll holder is characterized further by, provided inside the lid, a feed roll held by slide bearings accommodating springs and having a circumferential groove similarly to the feed roll, whose peripheral surface abuts on and is pressed against that of the feed roll when the lid is shut and locked by a lock mechanism; and an upper product guide arranged at a position corresponding to the lower product guide and attached to a mounting piece, and is characterized further by a control unit which, after the detector detects the absence of the succeeding product, causes the motor to rotate the feed roll to thereby pay out the succeeding product, and after the detector detects the presence of the succeeding product, causes the motor to rotate the feed roll a certain amount of rotation to thereby pay out the succeeding product up to the given position.

BRIEF DESCRIPTION OF THE DRAWINGS

FIG. 2C-1 is a side view of the roll holder;

FIG. 2C-2 is a sectional view of a lock mechanism;

DESCRIPTION OF THE PREFERRED EMBODIMENT

An embodiment of the present invention will now be described with reference to the drawings.

Figure 1:
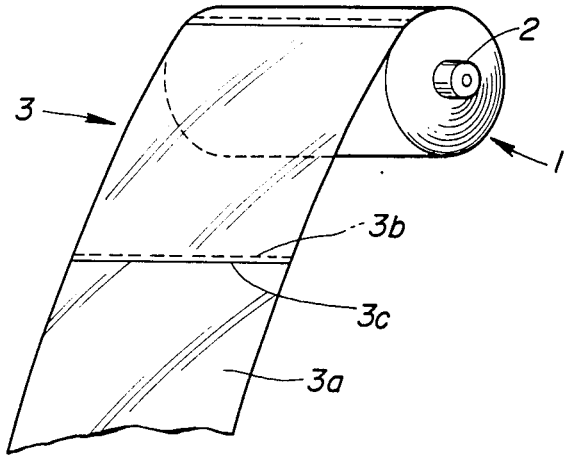
FIG. 1 is a perspective view of a roll of consecutive thin-film-like products.
Figure 3:
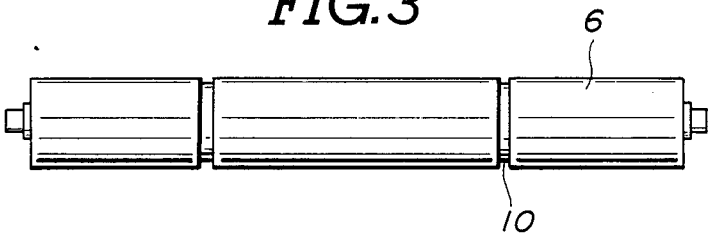
FIG. 3 is a front view of the feed roll.

FIG. 1 shows an example of a roll 1 to be held by a roll holder according to the present invention, composed of consecutive thin-film-like products 3 coiled around a winding core 2 which are used after individual products 3*a* are cut off along break lines 3*b* such as perforations that are provided between individual units of use along seal lines 3*c*. Although in the embodiment illustrated each product 3*a* is made into the form of a pouch confined by the seal lines 3*c*, it may take the form of a paper towel made of a paper sheet, for example.

Figure 2A:
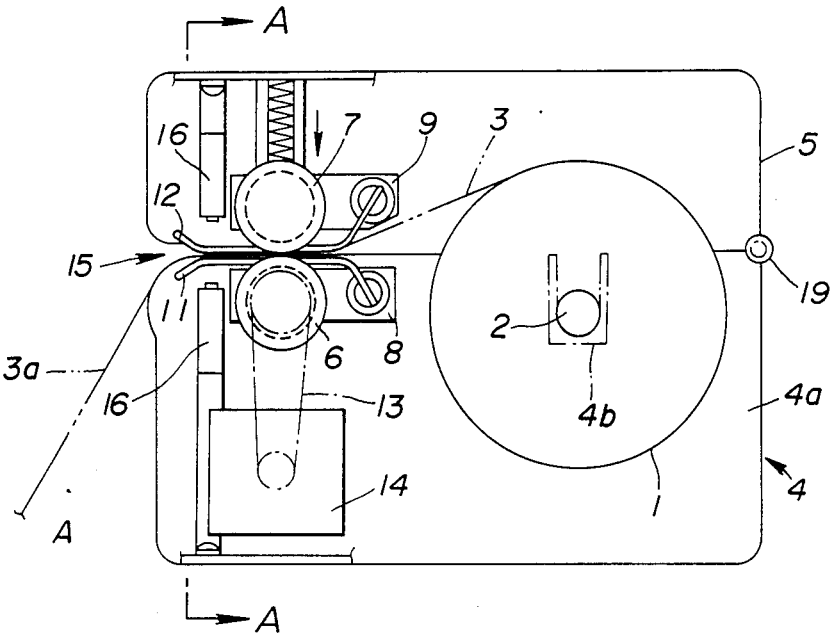
FIG. 2A is a view, partially in cross-section, of a roll holder according to the present invention.
Figure 2B:
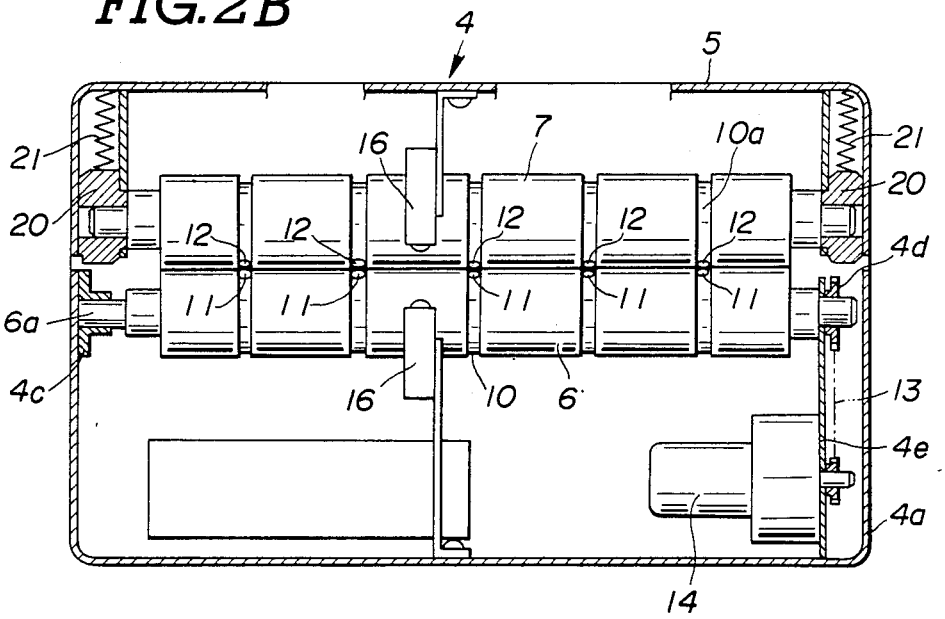
FIG. 2B is a sectional view taken along line A—A of FIG. 2A.
Figures 2, 2C:
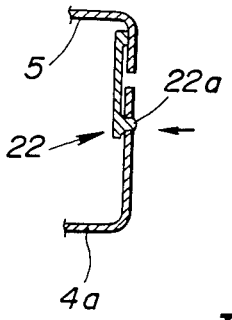
Figures 1, 2C:
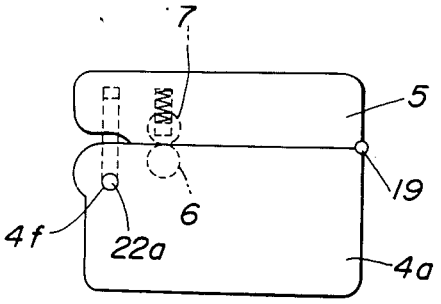
Figure 2D:
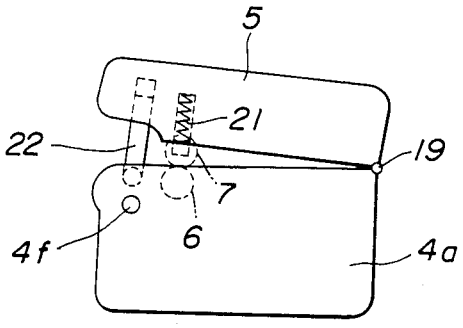
FIG. 2D is a side view of the roll holder with the lock mechanism unlocked.
Figure 2E:
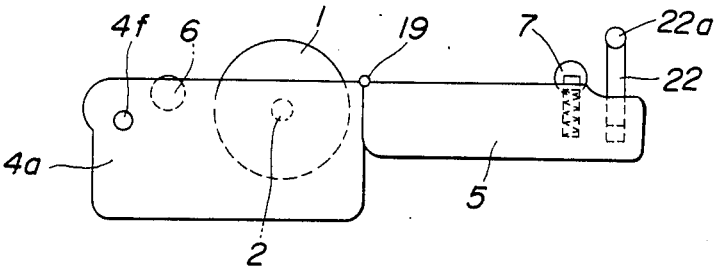
FIG. 2E is a side view of the roll holder with its lid opened fully.
Figure 2F:
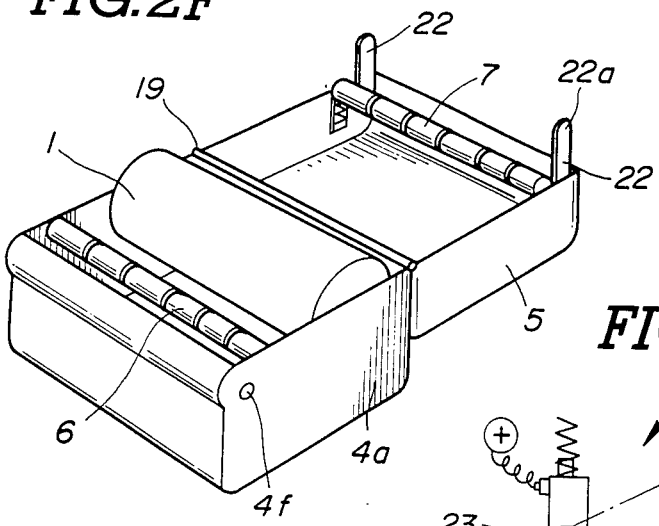
FIG. 2F is a perspective view of the roll holder with the lid opened fully.

The roll 1 is loaded inside a box-shaped roll holder 4 as shown in FIG. 2A.

The roll holder 4 is shaped like a box which comprises a body 4*a* and an open/shut-able lid 5 coupled via a hinge 19 to the former, holding portions 4*b* are provided in the inner rear section of either side wall of the body 4*a*, and the winding core 2 is held rotatably by these holding portions 4*b* so that the roll 1 is hung thereon.

In the inner front section of the body 4*a* a feed roll 6 having circumferential grooves 10 formed in the surface thereof is disposed in parallel with the roll 1, one end of a shaft 6*a* of the feed roll 6 is held by a bearing 4*c*, and the other end passes through the hole of a bulkhead 4*e* and has a pulley or sprocket 4*d* attached thereto.

The pulley or sprocket 4*d* is coupled via a belt or chain 13 to a motor 14, so that in response to driving of the motor 14 the feed roll 6 rotates in a given direction. A lower product guide 11 made, for example, of a piano wire whose base end is fixed to a mounting piece 8 is disposed so as to fit in the circumferential groove 10.

A detector 16 is disposed at a downstream position spaced a given distance from the feed roll 6 in a pay-out path 15 in which the consecutive thin-film-like products 3 run and stop, for detecting the presence/absence of a succeeding product 3*a* at that position.

On the other hand, inside the lid 5 slide bearings 20 are provided at a position corresponding to the feed roll 6, each being moved up and down by means of a spring 21, and another feed roll 7 having circumferential grooves 10*a* formed in the surface thereof similarly to the feed roll 6 is held by the slide bearings 20.

The feed roll 7 is urged by the springs 21 so that it abuts on the feed roll 6 and its peripheral surface is pressed against that of the latter. Reference numeral 22 indicates a lock mechanism whose base end is attached to the lid 5 and whose lower end has a projection 22*a* fitable in a hole 4*f* bord in the body 4*a*, so that as the lid 5 is shut by turning it about the hinge 19 the projection 22*a* fits in the hole 4*f* and is secured thereby, whereas as the projection 22*a* is pushed and released from the hole 4*f* the lock mechanism is unlocked.

The consecutive thin-film-like products 3 paid out from the roll 1 is pinched between the feed rolls 6 and 7 and guided in a given downstream direction by means of the pair of upper and lower product guides 11 and 12 extending in the given direction, so that the leading end reaches a prescribed pick-off position A.

Because one feed roll 6 out of the feed rolls 6 and 7 is coupled at its shaft end to the rotary shaft of the motor 14, for example, via the chain 13, in response to the rotation in a given direction of the motor 14 the feed roll 6 rotates and pays out the consecutive thin-film-like products 3 while pinching them in conjunction with the other feed roll 7.

In the pay-out path 15 formed by the pair of upper and lower product guides 11 and 12, the non-contact type detector 16 is disposed at a downstream position spaced a certain distance from the feed rolls 6 and 7.

This non-contact type detector 16 may be made by, for example, phototube, electrostatic capacitance type proximity switch, or ultrasonic switch. Specifically, the detector 16 of the embodiment illustrated is made by the phototube. That is, it includes a light-emitting element disposed on one side, a light-receiving element disposed on the other side opposite to that light-emitting element with the running line of consecutive thin-film-like products 3 interposed therebetween, a normally closed contact Pb for starting the motor 14, and a normally open contact Pa for starting a timer relay described hereinafter, and detects whether or not the consecutive thin-film-like products 3 serving as a shading substance is located at the position of the detector 16.

Figure 2G:
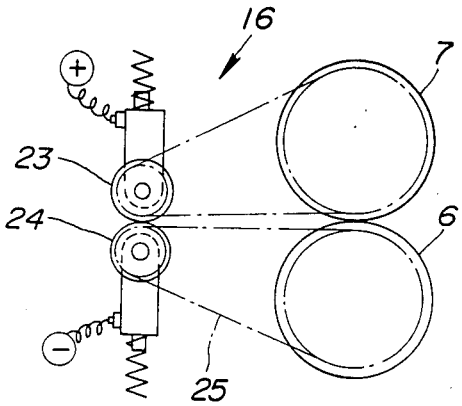
FIG. 2G is an explanation view of a contact type detector.
Figure 2H:
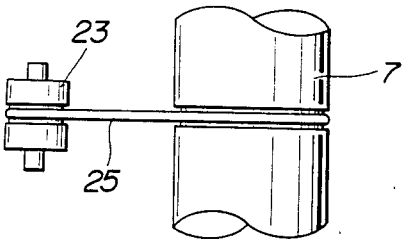
FIG. 2H is a plan view showing the relationship between feed rolls and rollers of the contact type detector.

The detector 16 may be replaced with a contact type detector 16 shown in FIGS. 2G and 2H. This contact type detector 16 comprises rollers 23 and 24 coupled via belts 25 to the feed rolls 6 and 7.

A weak electric current is caused to flow through the rollers 23 and 24, so that when the consecutive thin-film-like products 3 are absent the electric circuit is ON, whereas when the consecutive thin-film-like products 3 serving as a shielding substance are present it is OFF.

In a portion of the holder body 4 there are disposed the timer relay 17 having a normally closed contact $T_b$ and a relay 18 having two normally open contacts Ra1 and Ra2, these forming a part of the control system including the foregoing detector 16.

Figure 4:
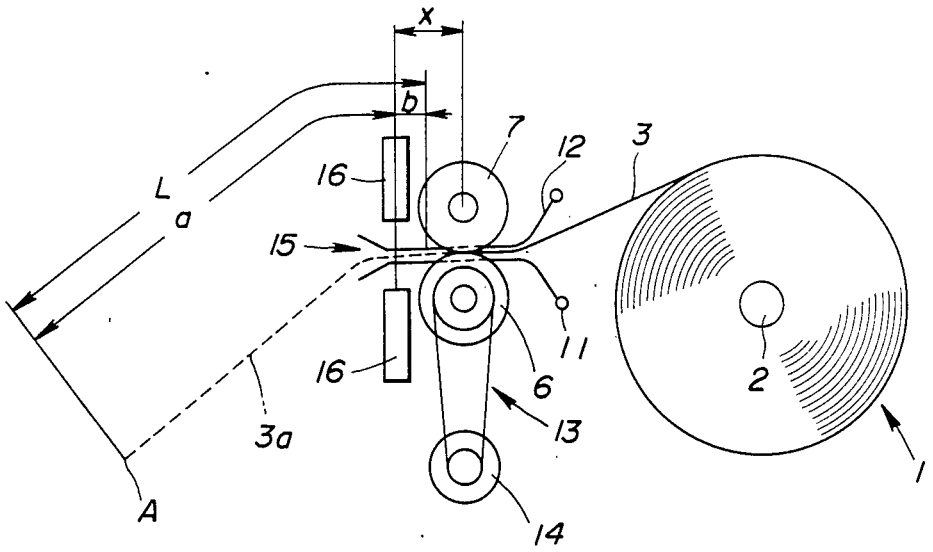
FIG. 4 is an explanation view showing the operating state of the roll holder.

FIG. 4 shows the operating state of the roll holder which causes the consecutive thin-film-like products 3 to either run or stop, in which a length X represents the distance between the feed roll 6 and detector 16, a length L represents the length of the product 3*a* which is the unit of use whose leading end corresponds to the prescribed pick-off position A with the trailing end corresponding to the portion of the break line 3*b* existing within the extent of the length X, a length a which is a part of the length L represents the distance between the detector 16 and prescribed pick-off position A, and a length b represents the distance between the break line 3*b* and detector 16.

As the leading product 3*a* is cut off from the consecutive thin-film-like products 3 along the break line 3*b*, the shading substance disappears from the area of the detector 16; thus, the detector 16 sends an absence signal to the motor 14 and relay 18 to start the motor 14, as a result, a new succeeding product 3*a* is paid out from the roll 1 by means of the feed rolls 6 and 7.

As this succeeding product 3*a* reaches the detector 16, the detector 16 detects the arrival of the same and sends another signal to the timer relay 17 to start the same and cause the motor 14 to continue its rotation.

As the succeeding product 3*a* runs and when it has been paid out by the length a, the timer relay 17 indicates that the time is up and a signal indicating the above is sent to the relay 18 to stop the rotation of the motor 14.

Figure 5:
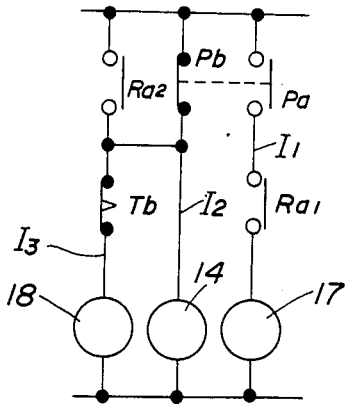
FIG. 5 is a circuit diagram of a control system.

FIG. 5 is a circuit diagram of the foregoing control system, in which across a power source there are connected parallelly a first series circuit $I_1$ including the timer relay 17, normally open contact RaI of the relay 18, and normally open contact Pa of the detector 16; a second series circuit $I_2$ including the motor 14, and normally closed contact Pb of the detector 16; and a third series circuit $I_3$ including the relay 18, normally closed contact Tb of the timer relay 17, and normally open contact Ra2 of the relay 18, wherein the normally closed contact Pb of the detector 16 is connected in parallel with the normally open contact Ra2 of the relay 18.

Describing the operating state of the foregoing system with reference to the circuit diagram, as the product 3*a* is cut off, the normally closed contact Pb of the detector 16 turns on to start the motor 14 and concurrently, the relay 18 is energized by means of the normally closed contact Tb to turn on the normally open contact Ra1 and Ra2, so that the relay 18 is held in the energized state itself.

Owing to the rotation of the motor 14 the feed rolls 6 and 7 are rotated. As the succeeding product 3*a* reaches up to the detector 16 having the length b, the normally closed contact Pb of the detector 16 turns off and concurrently the normally open contact Pa turns on.

At this time, because the normally open contact Ra2 of the relay 18 is held ON, the motor 14 continues to rotate, and due to turn-on of the normally open contact Pa of the detector 16 the timer relay 16 starts.

The timer relay 17 continues its operation for a preset given time interval, and upon its time-up, its normally closed contact $T_b$ is caused to turn off, the self-held state of the relay 18 is removed to turn off the normally open contacts Ra1 and Ra2, the rotation of the motor 14 is stopped, and the energized state of the timer relay 17 is terminated.

Because the given operating time interval of the timer relay 17 is adjusted so that the succeeding product 3*a* will be paid out by the length a from the detector 16 up to the prescribed pick-off position A by means of the rotation of the feed rolls 6 and 7 caused by the rotation of the motor 14, as soon as the succeeding product 3*a* passes by the detector 16 the timer relay 17 is caused to start due to turn-on of the normally open contact Pa; thus, the amount of pay-out is always regulated to the length a regardless of where the succeeding product 3*a* is cut off and located within the extent of the length X.

Accordingly, so far as a variation in amount of feed and the like due to the error of the length L, fluctuation of tension of the consecutive thin-film-like products 3, and working error of the roll holder can be settled within the extent of the length X, it is possible to pay out the leading end of a new succeeding product 3*a* surely up to the prescribed pick-off position A and stop the same there even when each product 3*a* is taken out repeatedly.

Further, if the length X is set to a value larger than that required for settling a variation estimated as above, the same holder can be applied to plural kinds of consecutive thin-film-like products 3 differing in standardized size of the product 3*a* without need of adjusting the timer relay 17.

As the leading product 3*a* whose leading end is located at the prescribed pick-off position A is picked off, the consecutive thin-film-like products 3 tend to be paid out in response to the cut-off operation. In this connection, to prevent a next leading product 3*a* from reaching within the extent of the length a when the old leading product 3*a* has been cut off completely from the consecutive thin-film-like products 3, braking action is required for the consecutive thin-film-like products 3.

In case a reduction geared motor is used as the motor 14, it is possible to cause the working resistance of a gear mechanism to act via the feed roll 6 on the pay-out movement of the consecutive thin-film-like products 3 as a sort of braking action, thus to make the working resistance of the gear mechanism be serviceable indirectly as the braking action. Other than the foregoing measures, the braking action can also be realized by setting a pushing force acting between the pair of feed rolls 6 and 7 larger than an ordinary value, or by the use of appropriate means for pressing a rubber roll or friction board against the roll 1.

As described hereinabove, according to the roll holder of the present invention, one of the feed rolls is mounted fixedly on the body, the other feed roll is equipped in the lid, these rolls are arranged so that the feed roll disposed on the side of the lid pushes the peripheral surface of the feed roll disposed on the side of the body by means of the lock mechanism, and the lid and body are coupled together by the lock mechanism, so that the consecutive thin-film-like products can be set in the roll holder by laying the consecutive thin-film-like products on the feed roll without causing deformation, shutting the lid, and setting the lock mechanism. In case the consecutive thin-film-like products can not be paid out correctly during the operation, such abnormal operation can be amended and repaired easily by unlocking the lock mechanism and opening the lid.

As a result of cutting off of the product 3*a* during the preceding operation, the detector 16 detects the absence of the leading product 3*a* to cause a new succeeding product 3*a* to be paid out smoothly and its leading end to be located at the prescribed pick-off position A spaced a given distance from the roll 1, and the foregoing operation is performed by the use of the control system including the non-contact type or contact type detector 16 and the like; thus, the operation of the roll holder of the present invention is reliable and causes little malfunctions, and the product 3*a* is paid out surely one at a time, as a result, there arises neither an inconvenience of cutting off erroneously two or more products 3*a* concurrently nor an uneconomical use of the device.

The user can take out the product 3*a* simply by picking the leading end of the product 3*a* at the prescribed pick-off position A and cutting off the same without performing any manipulation on the roll holder.

Further, the product 3*a* can be paid out reliably up to the given position without being influenced by a variation in length tolerance of the product 3*a*, a variation in amount of feed of the consecutive thin-film-like products 3, and the like, and individual succeeding products 3*a* can be paid out surely up to the given position even if the take-out operation is performed repeatedly.

In addition, the present invention has several superior functional effects, one of which is that by setting the length X sufficiently large, the same holder can be applied equally to plural kinds of consecutive thin-film-like products differing in standardized size of the product 3*a* without need of any adjustment.

What is claimed is:

1. A roll holder for holding rotatably a roll of consecutive thin-film-like products which are separable along a break line provided between individual units of said products and for paying out a succeeding product up to a given position upon separating a product from said roll along the break line, said holder having a body and a lid openable and closeable with respect to the body via a hinge, said body, on an inside thereof, comprising:

holding means for holding rotatably a winding core so as to hand said roll;

a first feed roll disposed in parallel with said roll and having a circumferential groove, one end of said first feed roll being supported in a bearing and another end of said first feed roll passing through a hold of a bulkhead and having a sprocket attached thereto, said sprocket being drivingly coupled via a chain to a motor;

a lower product guide arranged along said circumferential groove and attached to a mounting piece; and a detector means, spaced a given distance from said first feed roll in a pay-out path along which said consective thin-film-like products move and stop, for detecting a succeeding product;

said lid, on an inside thereof, comprising:

a second feed roll held by slide bearings and accommodating springs and having a circumferential groove similarly to said first feed roll, said second feed roll pressing against said first feed roll when said lid is shut and locked by a lock mechanism; and an upper product guide arranged at a position corresponding to said lower product guide and attached to a corresponding mounting piece; and a control unit which, upon said detector means an absence of the succeeding product, causes said motor to rotate said first feed roll and thereby pay out the succeeding product a first distance and, upon said detector means detecting a presence of the succeeding product, causes said motor to rotate said first feed roll a certain amount in order to pay out said succeeding product a second distance.

* * * * *